US005121908A

United States Patent [19]

Shatkus et al.

[11] Patent Number: 5,121,908

[45] Date of Patent: Jun. 16, 1992

[54] WORKPIECE HOLDER

[76] Inventors: Robert D. Shatkus, 3843 W. 65th Pl., Chicago, Ill. 60629; Adolf S. Jerger, 6746 W. 89th Pl., Oaklawn, Ill. 60453

[21] Appl. No.: 597,053

[22] Filed: Oct. 15, 1990

[51] Int. Cl.[5] ..... B25B 1/00

[52] U.S. Cl. ..... 269/99; 269/243; 269/254 R

[58] Field of Search ..... 269/243, 254 R, 224, 269/900, 91-94, 99-101, 282, 283

[56] References Cited

U.S. PATENT DOCUMENTS

| | | | |
|---|---|---|---|
| 748,048 | 12/1903 | Colt . | |
| 1,067,902 | 7/1913 | Ebert . | |
| 1,402,893 | 1/1922 | Sahlin . | |
| 1,854,078 | 4/1932 | Strawn . | |
| 2,111,468 | 3/1938 | Corkum | 269/243 |
| 2,247,656 | 7/1941 | Friedrich . | |
| 2,291,255 | 7/1942 | Powell | 269/254 R |
| 2,510,077 | 6/1950 | Coffman | 269/254 R |
| 2,727,325 | 12/1955 | Jurinic . | |
| 2,913,965 | 11/1959 | Collis . | |
| 3,020,041 | 2/1962 | Peterson et al. . | |
| 3,791,640 | 2/1974 | Clugage . | |
| 3,963,230 | 6/1976 | Jankowski | 269/224 |
| 4,027,867 | 6/1977 | Pollington | 269/94 |
| 4,078,782 | 3/1978 | Carlson | 269/283 |
| 4,157,819 | 6/1979 | Meyer | 269/900 |
| 4,196,897 | 4/1980 | Gordon | 269/99 |
| 4,261,558 | 4/1981 | Carossino . | |
| 4,505,010 | 3/1985 | Arenhold | 269/254 R |
| 4,804,171 | 2/1989 | Dornfeld | 269/254 R |

OTHER PUBLICATIONS

Low-profile Riser Clamp Jul. 1990/Metlfax.

Two Piece Milling Vise Advertisement.

*Primary Examiner*—Robert C. Watson

*Attorney, Agent, or Firm*—Rockey and Rifkin

[57] ABSTRACT

The workpiece holder includes a solid jaw and a flexible jaw made of hardened steel and supported by the machine table. The solid jaw and flexible jaw are movable relative to the table such that workpieces of various sizes can be positioned at a predetermined location relative to the machine tool. The solid jaw, once positioned, is unmovable. The flexible jaw can flex approximately 0.002-0.003 of in inch relative to the solid jaw such that the workpiece can be gripped or released by flexing or unflexing the flexible jaw. To provide the flexing movement, the flexible jaw is formed with a narrowed neck portion which can be deformed to create a flex point. A screw extending between the solid jaw and flexible jaw supports a nut which provides the force for flexing the flexible jaw. Because the amount of flex required to grip and release the work piece is very small, the screw and nut arranagmenet can grip and release a workpiece with only a quarter turn of the nut. Thus, the workpiece holder of the invention can accurately position and hold workpieces during repetitive maching or related operations operations with a minimum expenditure of time and effort.

12 Claims, 1 Drawing Sheet 6
1
W
W
24
20
25
21
26
22
9
17
13
35
33
15
61
27
29
31
47
7
5
3
54
58
59
55
60
56
57
53
63
43
45
39
37
41

1
9
11
17
15
27
29
X
X
Y
Y
7
39
3
5

WORKPIECE HOLDER

BACKGROUND OF THE INVENTION

The invention relates, generally, to a workpiece holder and, more particularly, to a workpiece holder for use with a machine tool for cutting, boring or drilling workpieces.

The typical machine tool includes a horizontal machine table disposed adjacent to the tool for supporting the workpiece. The table supports a mechanism for gripping the workpiece in a predetermined position relative to the tool.

One such prior art gripping mechanism consists of a pair of jaws supported by the horizontal machine table. The jaws are movably mounted on the table to accommodate workpieces of various sizes and to properly position the workpieces relative to the milling tool. One of the jaws is a "fixed" jaw which, after being initially positioned on the table for a specific workpiece and operation, is not moved. The other jaw is a "movable" jaw having a base mounted to the table and a jaw member slidably supported on the base. The jaw member can be moved relative to the base to releasably grip the workpiece between it and the "fixed" jaw. In the known devices, the jaw member is moved into and out of engagement with the workpiece either by a screw or a camming mechanism.

One problem with the known devices is that neither the screw nor the camming mechanism can accurately and precisely position new workpieces during repetitive machine operations. As a result, numerous man hours are lost precisely positioning each new workpiece. Moreover, the known devices require relatively extensive manipulations of either the screw or camming member to grip, release and position the workpiece.

One known alternative to the jaw-type devices discussed above, are straps which extend over the top of the workpiece to, in effect, tie the workpiece to the table. The straps, however, cannot precisely position workpieces during repetitive machine operations. Moreover, because these straps overlie the workpiece, access to the workpiece by the machine tool is partially obstructed.

A workpiece holder that ca simply and precisely grip and position workpieces for repetitive machine operations is desired.

SUMMARY OF THE INVENTION

The workpiece holder of the invention overcomes the above-noted shortcomings of the prior art and includes a solid jaw and a flexible jaw both made of hardened steel and supported by the machine table. The solid jaw and flexible jaw are movable relative to the table such that various sized workpieces can be positioned at a predetermined location relative to the machining tool. The solid jaw, once positioned, is fixed to the table and is unmovable. The flexible jaw is also fixed to the table once it is initially positioned; however, it can flex approximately 0.002–0.003 of an inch relative the solid jaw such that a workpiece can be gripped and released between the solid and flexible jaws by flexing and unflexing the flexible jaw. The flexible jaw is formed with a tapered neck portion having a relatively narrow cross-section which is deformed to create the flexing movement. A screw extending between the solid jaw and flexible jaw supports a nut which provides the force for deforming the flexible jaw. Because the amount of flex required to grip and release the work piece is very small, i.e. 0.002–0.003 of an inch, only a quarter turn, or less, of the nut is required to deform the flexible jaw. Thus, the workpiece holder of the invention can precisely position and hold workpieces during repetitive machining operations or related operations such as inspections with a minimum expenditure of time and effort.

OBJECTS OF THE INVENTION

It is a general object of the invention to provide an improved workpiece holder for a machine tool.

It is another object of the invention to provide a workpiece holder that can accurately position and hold a workpiece.

It is a further object of the invention to provide a workpiece holder that can grip, release and position a workpiece with a minimum expenditure of time and effort.

It is yet another object of the invention to provide a workpiece holder that can accommodate workpieces having a wide variance in size.

It is a still further object of the invention to provide a workpiece holder that holds the workpiece in an unobstructed position that is free from shavings and debris.

Other objects of the invention, in addition to those set forth above, will become apparent to one of ordinary skill in the art from the following detailed description of the invention.

DETAILED DESCRIPTION OF THE INVENTION

Figure 1:
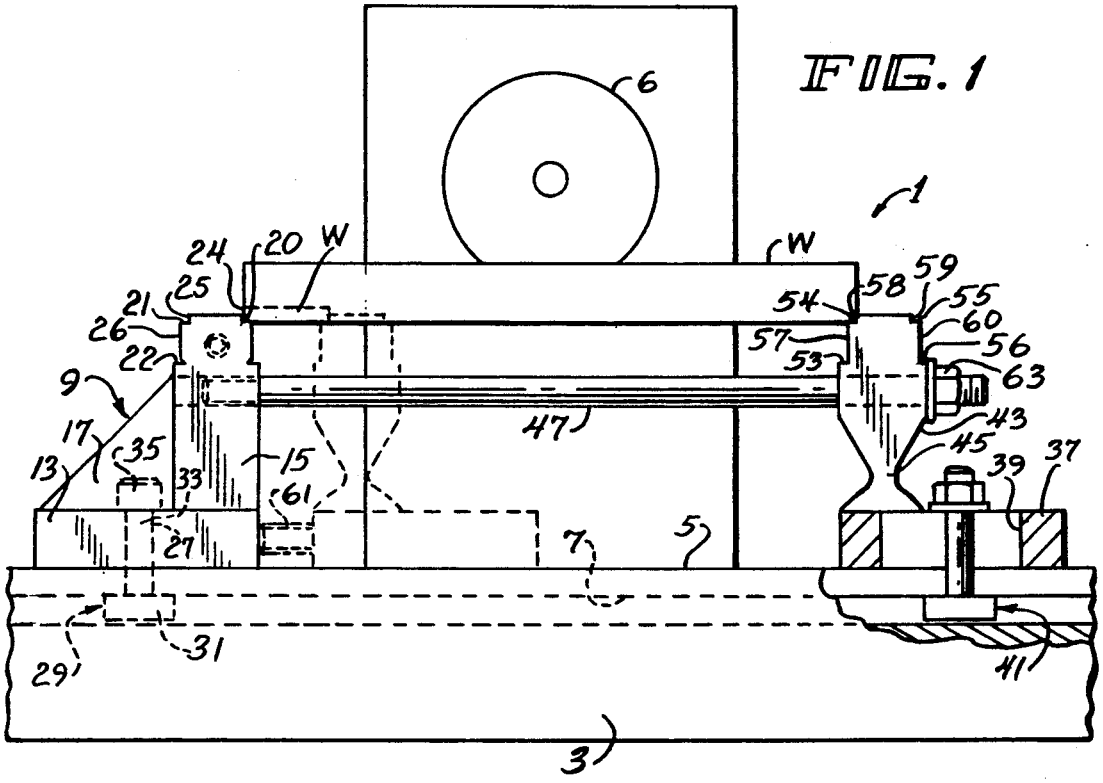
FIG. 1 shows a side view of the workpiece holder of the invention associated with a machine tool.

Referring more particularly to the figures, the workpiece holder of the invention 1 is shown mounted on a standard machine table 3 of a machine tool 4. Table 3 has a flat horizontal surface 5 disposed below the milling tool 6. Surface 5 has three slots 7 formed therein extending for substantially the entire length of table 3. In cross-section, slots 7 have an inverted T-shape where the vertical section of the T extends through surface 5.

Figure 2:
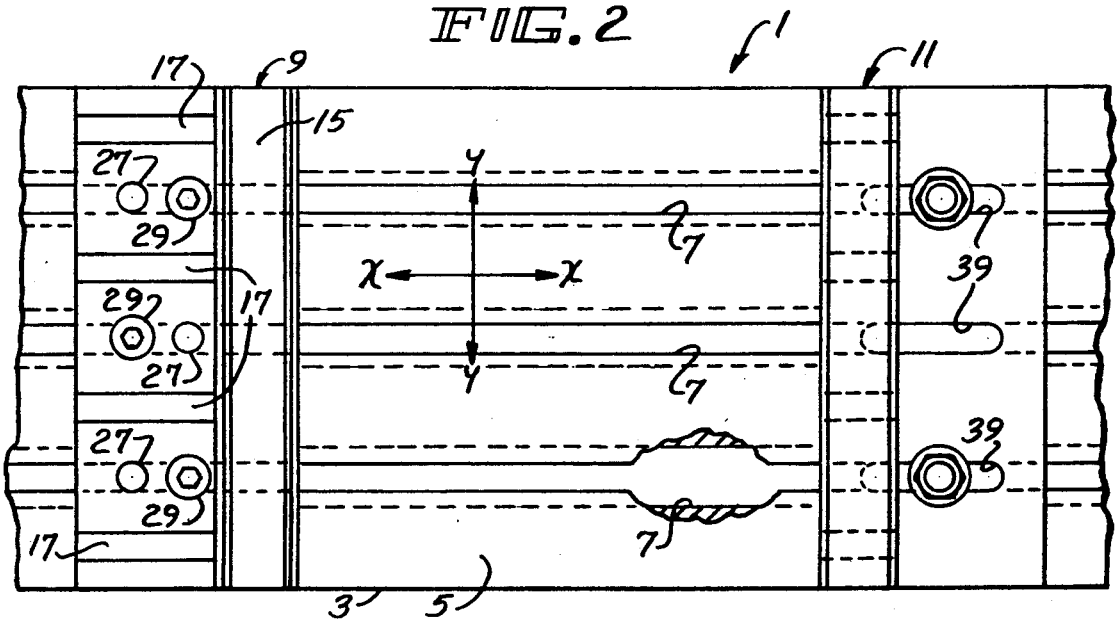
FIG. 2 shows a plan view of the workpiece holder of the invention.

Workpiece holder 1 includes a first solid jaw assembly 9 and a second flexible jaw assembly 11 constructed of hardened steel by any suitable process. Solid jaw assembly 9 consists of a base portion 13 dimensioned to extend across the width of table 3 as best shown in FIG. 2. Base portion 13 rigidly supports a jaw member 15. A plurality of reinforcing members 17 are connected between base portion 13 and jaw member 15 to ensure the rigidity of jaw member 15.

Jaw member 15 includes squared cut-outs 19, 20, 21 and 22 which extend for the width of jaw member 15. The faces 23–26 created by cut-outs 19–22 are arranged perpendicular to surface 5 to grip and retain workpieces at a fixed parallel orientation relative to surface 5.

A plurality of bores 27 are formed in base portion 13 for receiving bolts 29. Bolts 29 are arranged such that their heads 31 are restrained in slots 7 with their threaded studs 33 extending out from slots 7 and through bores 27. Nuts 35 engage studs 33 such that when nuts 35 are tightened against base portion 13, the position of solid jaw assembly 9 is fixed relative to worktable 3. When nuts 35 are loosened, the solid jaw assembly 9 can be slid horizontally relative to machine table 3.

Flexible jaw assembly 11 includes a base portion 37 having slots 39 for receiving bolts 41 which function to position flexible jaw assembly 11 in the same manner as solid jaw assembly 9. A flexible jaw member 43 is fixed to base portion 37. Flexible jaw member 43 includes a tapered flex-joint 45 having a relatively narrow cross-section as compared to the rest of jaw member 43 which can be deformed upon application of an external force to allow the flexible jaw member 43 to move approximately 0.002–0.003 of an inch, as will hereinafter be described. Cut-outs 53–56 extend the width of jaw member 43 to form jaw faces 57–60. Unlike jaw faces 23–26, jaw faces 57–60 are offset from the vertical by 0.002–0.003 of an inch such that when jaw member 43 is flexed inwardly, the faces 57–60 will be disposed perpendicularly to surface 5 to hold the workpiece W parallel to machine table 3.

A threaded stud 47 spans the distance between the flexible jaw assembly 11 and the solid jaw assembly 9 and is fixed to solid jaw assembly 9. The threaded stud 47 passes through a smooth bore 51 formed in flexible jaw member 43 such that jaw member 43 can freely slide relative to threaded stud 47. A nut 63 engages threaded stud 47 such that the tightening of nut 63 against jaw member 43 causes jaw member 43 to be flexed inwardly about flex-joint 45. When the nut 63 is loosened, jaw member 43 will return to its unflexed position.

In operation, the solid jaw assembly 9 is fixed to the work surface 5 such that the workpiece W will be in a predetermined location relative to the milling tool. A shim having a thickness of 0.002–0.003 of an inch is placed between the flexible jaw member 43 and the workpiece W. The flexible jaw assembly is then secured to the work table via bolts 41 with the shim between the jaw member 43 and workpiece W. The shim is removed such that a 0.002–0.003 inch gap results between the workpiece W and jaw member 43. This gap allows clearance for inserting workpieces between the jaws. Once workpiece W is located between the jaws the nut 63 is tightened against the flexible jaw member 43, to flex it against the workpiece and securely grip and position the workpiece. After the machining operation has been completed on the workpiece, the nut 63 is loosened such that the flexible jaw member 43 returns to the unflexed position and releases the workpiece. Only a ¼ turn, or less, of nut 53 is required to flex the flexible jaw the necessary 0.002–0.003 of an inch such that the workpiece holder 1 can quickly and easily grip and release the workpieces. When performing repetitive machining operations on similar workpieces, the flexing motion allows for quick and simple removal and replacement of the workpieces while ensuring that each workpiece is precisely located.

The size of the workpiece that can be clamped by the workpiece holder of the invention is limited only by the size of the machine table 3 and threaded stud 47. Moreover, as is evident from FIG. 1 the jaws 9 and 11 do not obscure the workpiece W such that machining operations can be performed over the entire surface of the workpiece. Because the workpiece W is held in an elevated position relative to the work table 3, shavings and debris generated during the machining operation do not obstruct access to the workpiece.

A support stud 61 may also be used between the base portions of the flexible and rigid jaws to further stabilize the jaws if desired. Finally, jaw assemblies 9 and 11 can be rotated 180 degrees about their vertical axis and mounted on table 3 such that faces 26 and 60 face one another. In this manner, workpieces that are slightly longer than the machine table 3 can be accommodated by the workpiece holder of the invention.

While the preferred embodiment of this invention has been shown and described in some detail, it will be understood by one of ordinary skill in the art that this description is made merely by way of example, and that the invention is to be limited in scope only by the appended claims.

What is claimed is:

1. A workpiece holder for use with a machine of the type including a work table, comprising:
   a) a rigid first jaw;
   b) means for mounting said first jaw on said work table;
   c) a second jaw having a tapered section of relatively narrow cross-section to allow flexing movement of the second jaw;
   d) means for movably mounting said second jaw on said table; and
   e) means for flexing said second jaw to move the second jaw toward and away from the first jaw to thereby grip and release the workpiece.

2. A workpiece holder according to claim 1, wherein said means for flexing said second jaw includes a nut mounted on a threaded member whereby said nut when rotated in a first direction creates a force on said second jaw.

3. Workpiece holder according to claim 2, wherein said threaded member is fixed to said rigid first jaw.

4. The workpiece holder according to claim 2, wherein said second jaw can to move relative to said threaded member.

5. A workpiece holder for use with a machine of the type including a work table, comprising:
   a) a rigid first jaw;
   b) means for movably mounting said first jaw on said work table including threaded members engageable with work table;
   c) a flexible second jaw;
   d) means for movably mounting said second jaw on said work table including threaded members engageable with the work table; and
   e) means for flexing said second jaw toward and away from the first jaw to thereby grip and release the workpiece.

6. The workpiece holder according to claim 5, wherein said second jaw includes a tapered section of relatively narrow cross-section to provide the flexing movement.

7. A workpiece holder for releasably clamping a workpiece comprising:
   a) a surface;
   b) a first jaw mounted to said surface;
   c) a second jaw mounted to said surface, said second jaw being made of a deformable material whereby application of a force to said second jaw flexes said second jaw into and out of engagement with said workpiece;
   d) means on said first jaw and said second jaw for engaging said workpiece such that said workpiece is clamped in an elevated position relative to said surface; and e) means for applying said force to said second jaw.

8. The workpiece holder according to claim 7, wherein said means for applying said force to said second jaw consists of a threaded member fixed to said first jaw and a nut engageable with said threaded member such that movement of the nut relative to the threaded member results in the flexing of said second jaw.

9. The workpiece holder according to claim 7, further including means for mounting said first and said second jaw to said surface including a threaded member engageable with said surface.

10. The workpiece holder according to claim 7, wherein said means for engaging includes at least one face formed on said first jaw perpendicular to said surface and at least one face formed on said second jaw offset from perpendicular to said surface a predetermined distance whereby when said second jaw is flexed said at least one face on said second jaw will be perpendicular to said surface.

11. The workpiece holder according to claim 7, wherein said surface is the machine table of a milling machine tool.

12. A workpiece holder for use with a machine of the type including a work table, comprising:

a) a rigid first jaw;

b) means for movably mounting said first jaw on said work table;

c) a flexible second jaw;

d) means for movably mounting said second jaw on said work table; and e) means for flexing said second jaw to move the second jaw toward and away from the first jaw to thereby grip and release the workpiece including a nut mounted on a threaded member, said threaded member being fixed to said rigid first jaw whereby said nut when rotated in a first direction creates a force on said second jaw.

* * * * *